United States Patent [19]

Koponen et al.

[11] 4,271,601

[45] Jun. 9, 1981

[54] WEB DRYER OPERATING ON THE AIR FLOAT PRINCIPLE

[75] Inventors: Vesa Koponen; Charles Stengard, both of Turku, Finland

[73] Assignee: Valmet Oy, Finland

[21] Appl. No.: 74,440

[22] Filed: Sep. 11, 1979

[30] Foreign Application Priority Data

Sep. 11, 1979 [FI] Finland ..... 782775

[51] Int. Cl.[3] ..... F26B 13/20

[52] U.S. Cl. ..... 34/156; 34/155; 226/97; 239/558; 239/DIG. 7

[58] Field of Search ..... 34/155, 156; 239/DIG. 7, 590, 558, 518; 226/97

[56] References Cited

U.S. PATENT DOCUMENTS

| | | | |
|---|---|---|---|
| 3,181,250 | 5/1965 | Vits | 34/156 |
| 3,199,224 | 8/1965 | Brown | 34/155 |
| 3,462,085 | 8/1969 | Nugarus | 239/590 |
| 3,861,062 | 1/1975 | Wymann | 34/155 |
| 3,936,953 | 2/1976 | Chance et al. | 34/156 |
| 3,995,375 | 12/1976 | Weinmann | 34/155 |
| 4,137,644 | 2/1979 | Karlsson | 34/156 |

FOREIGN PATENT DOCUMENTS

| | | | |
|---|---|---|---|
| 154674 | 1/1954 | Australia | 239/DIG. 7 |

*Primary Examiner*—Larry I. Schwartz
*Attorney, Agent, or Firm*—Steinberg & Raskin

[57] ABSTRACT

Apparatus for drying a web, such as a paper web, including a plurality of nozzle members successively located one after the other both in and transverse to the direction of travel of the web, each of the nozzle members defining a substantially annular slit and a carrying surface associated with the slit for directing gaseous drying fluid substantially contiguous with the carrying surface in a substantially radial flow field relative to the annular slit and in a direction substantially parallel to the web.

6 Claims, 5 Drawing Figures

WEB DRYER OPERATING ON THE AIR FLOAT PRINCIPLE

BACKGROUND OF THE INVENTION

The present invention concerns a web dryer operating according to the air floating principle, comprising a plurality of nozzle members by which air, or an equivalent gaseous fluid, is blown into contiguity with the web that has to be dried, and which is at the same time supported without mechanical contact, and said nozzle members having a supporting surface producing said supporting effect.

Means which are based on the blowing of gas and operate according to the air float principle are employed on paper manufacturing and processing machines for contactless cleaning, drying and stabilizing of the web. In the operations mentioned, the gas is introduced with the aid of various nozzle means on one or both sides of the web under treatment, the gas being thereafter drawn off before the next nozzle for reuse.

The dryers known in prior art for contactless treatment of the web (float dryers) are composed of a plurality of nozzles from which are directed against the web a gas flow supporting and drying the web. The nozzles of the prior art used in said dryers can be divided into two groups: overpressure nozzles and nozzles with subatmospheric pressure. The operation of the former type is based on the so-called air cushion principle, wherein the air jet causes a static overpressure in the space between the nozzle and the web. The group of subatmospheric pressure nozzles includes the so-called airfoil nozzles, which attract the web and stabilize the running of the web. The attraction acting on the web is well known to derive from a flow field of the gas parallelling the web, causing a static under-pressure between the web and the supporting surface of the nozzle, or the so-called carrying surface. It is frequent that the so-called Coanda phenomenon is employed in overpressure as well as subatmospheric pressure nozzles to guide the air in desired direction.

The overpressure nozzles in float dryers of the prior art direct sharp air jets substantially against the web. Such a localized impingement of the air jet on the web significantly enhances the heat transfer at the point where the jet and the web meet, thus giving rise to non-uniform distribution of the heat transfer coefficient in the longitudinal direction of the web, and this may cause quality defects in the web that is being treated. A further detriment when overpressure nozzles are being used is that because of the over-pressure feature they may not be used in one-sided treatment of the web.

Regarding the patent literature associated with the present invention, reference is made to the following patents: U.S. Pat. No. 3,711,960, Finnish Pat. No. 42 522 and German publicizing print No. 2 020 430.

The design of the dryers known through the said U.S. Pat. No. 3,711,960 and the German publicizing print No. 2 020 430 and of their subatmospheric pressure nozzles, is characterized by the feature that the nozzle slit opening on the side of the entry margin of the nozzle's carrying surface is extended onto a curved flow guiding surface connecting to the front margin of the carrying surface, so that the flow can be made to follow the carrying surface. These dryers of the prior art present the drawback that the blowing action parallel to the web tends to eject drying gas that has already been cooled in the preceding suction space, thereby lowering the differential temperature between the web and the drying gas and as a consequence reducing the heat transfer capacity. In dryers known in the art, the distance of the web from the carrying surface will be quite small (2–3 mm), which imposes high requirements on the smoothness and straightness of the drying surface (the carrying surface). This implies major requirements to be imposed on the design in the manufacturing of great width (over 3 m) dryers spanning the whole web.

Through the above-mentioned Finnish Pat. No. 42 522 a dryer is known by the nozzles of which the air is blown on one side of the web in the form of jets parallelling it and which in the breadth direction of the web give rise to discontinuities, for which reason a non-uniform heat transfer capacity is experienced. For the same reason the web stability is also poor, and this dryer cannot be used to handle thin webs, owing to the fluttering which is produced in their case. It is also impossible in this nozzle to employ high blowing rates, and the nozzle is not usable in two-sided web treatment. In connection with modern, high output paper manufacturing and conversion machines the dryers considered will be bulky, space-consuming and expensive. Owing to the low stabilizing power of the carrying surface in dryers of prior art, it is further noted that the one-sided treatment of heavy material webs has previously only been possible in the horizontal plane, with blowing from underneath the web. This fact has tended to restrict the designing of the dryer and to increase the apparatus size.

SUMMARY OF THE INVENTION

The object of the present invention is to avoid the drawbacks mentioned and to create a dryer wherein it is possible to improve considerably the evaporating and stabilizing capacity from what they have been in prior art.

It is further an object of the invention to produce a dryer of the type in question which has a specific energy consumption considerably lower than those of prior art.

In order to achieve the objects mentioned, the invention is mainly characterized in that the carrying surface of the dryer is defined by a plurality of separate nozzle members disposed in the direction of travel of the web after each other and side by side and which present a substantially annular nozzle slit, and a carrying surface associated with the nozzle members into contiguity with which the drying gas is conducted in a substantially radial flow field in directions substantially parallel to the web.

The higher than previous specific evaporating capacity of the dryer fulfilling the criteria mentioned is mainly based on the higher heat transfer coefficient between the web and the drying gas achieved with its aid. Three partial factors contributing to an improved heat transfer factor may be mentioned. The first partial factor is that as a result of the radial flow field applied on the carrying surface of the dryer of the invention, one achieves a smaller distance between the web and the carrying surface than is obtained in conventional apparatus. Another partial factor is that owing to the radial flow pattern, its flow cross section varies in configuration and the turbulence introduced thereby improves the heat transfer. The third partial factor is that in the dryer of the invention no ejection of air to the next nozzle is encountered.

The reduction of the specific energy consumption in the dryer of the invention is partly due to the lower specific resistance, compared with other equivalent designs, of the nozzle slit applied in the invention and partly to the circumstance that in the invention no flow guiding members are needed which would dissipate pressure (i.e., energy).

The higher stabilizing capacity of the carrying surface in the dryer of the invention, compared with dryers of prior art, is partly a result of the avoidance, already mentioned, of ejection into the air space of the next nozzle, and partly is due to the fact that the radial flow field applied in this dryer binds the web symmetrically in all directions.

DESCRIPTION OF THE DRAWINGS

In the following, the invention is described in detail with reference being made to certain embodiment examples of the invention, presented in the figures of the attached drawing, but to the details of which the invention is not confined.

DESCRIPTION OF THE PREFERRED EMBODIMENTS

Figure 1:
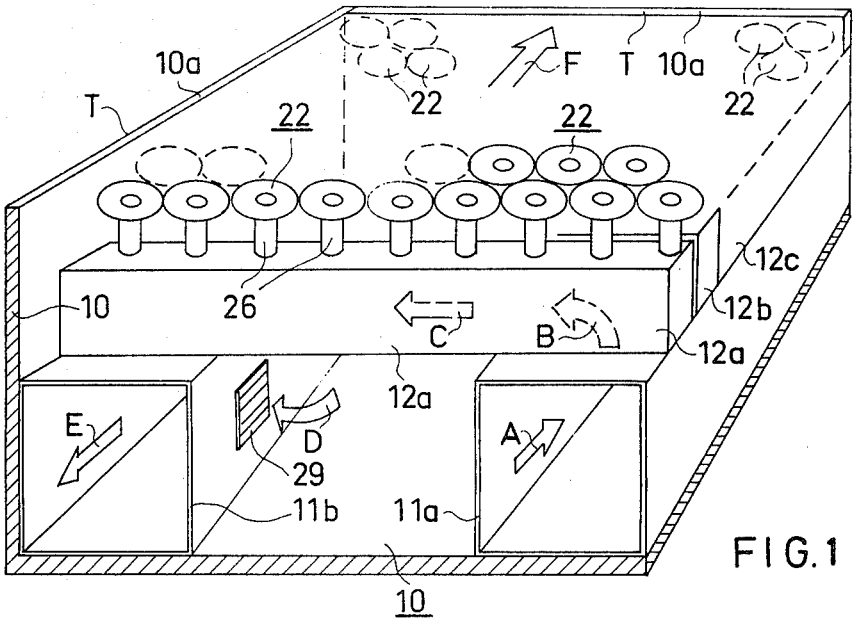
FIG. 1 displays, axonometrically, partly in section a view of the air-supported dryer of the invention.
Figure 3:
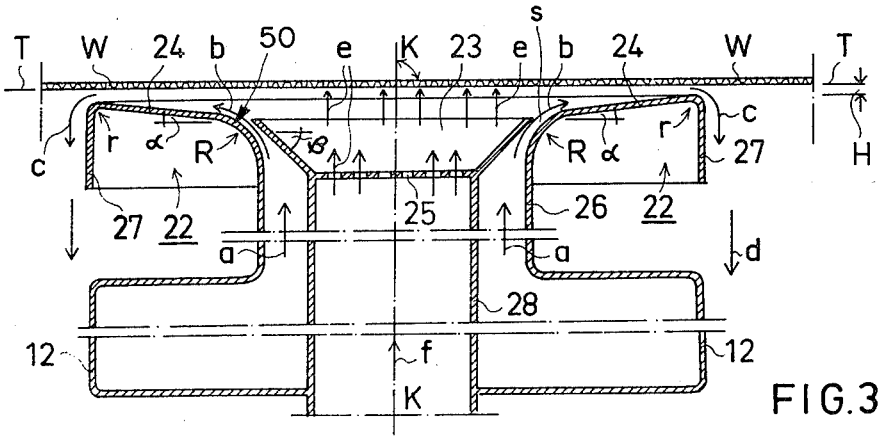
FIG. 3 presents a central axial section through the nozzle member employed in the floating dryer of the invention.

The floating dryer presented in FIG. 1 consists of a box-type frame part 10, with the carrying plane T—T of the dryer spaced the distance H from its top margin 10*a* (FIG. 3). The material web to be dried, W, (a paper web for instance) is conducted to pass over the carrying plane T—T, using means known in the art, which need not be more fully described in this connection.

As shown in FIG. 1, there has been arranged in the housing 10 an entry passage 11*a* for the drying gas (air for instance) and on the other end of the housing 10, a drying gas exit passage 11*b*. The entrance of the drying gas is indicated by the arrow A and its exit by arrow E. Over the passages 11*a* and 11*b* have been fitted distribution headers 12*a*, 12*b*, 12*c* etc. transversal to the direction of travel F of the web. The distribution headers 12 open at one end, on the underside, into the entry duct 11*a*, the other end being closed.

Connected with the distribution headers 12 is a set of nozzle members 22 presenting, as taught by the invention, an annular nozzle slit, and these nozzle members communicating by respective connecting pipes 26 with the distribution header 12. The carrying surfaces 24 of the nozzle members 22 define the carrying plane T—T of one air-supported dryer, and there is a plurality of such nozzle members 22 arranged are after the other in the direction of web travel and side by side, i.e., transverse to the direction of web travel.

Figure 2:
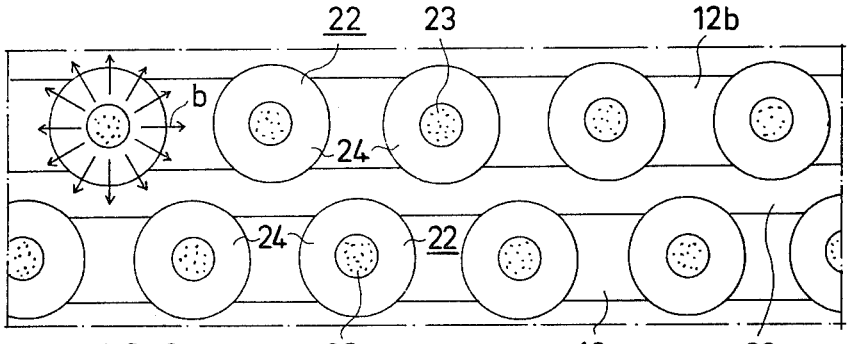
FIG. 2 shows, viewed from above, part of the web supporting plane consisting of nozzle members, in a dryer of the invention.

The disposition of the nozzle members 22 with reference to each other is illustrated in FIG. 2, and FIG. 3 illustrates the detailed design of a typical one of the nozzle members 22.

As shown in FIG. 3, the nozzle member 22 is constituted by an outer member 50 having an upwardly and outwardly extending frusto-conical surface comprising the carrying surface 24 and defining a central aperture and which terminates in a downwardly extending skirt 27 and an inner guiding member 23 located in the aperture defined by the carrying surface 24, also having a frusto-conical configuration. The carrying surface 24 has an integral portion having a radius of curvature R which communicates with the connecting pipe or gas supply tube 26 of the nozzle member 22 which itself is in fluid communication with the header 12. An annular nozzle slit s is defined between the inner surface of outer member 50 and the outer surface of the inner member 23. As noted above, the carrying surface of the nozzle member is frusto-conical, its angle $\alpha$ being preferably between 1° and 10°. The radius of curvature R of the outer member 50 is preferably considerably larger than the radius of curvature r of its outer margin.

The inner guiding member 23 guides the entering flow, and as shown in FIG. 3 this member is plate-like so that it has on its margins, upwardly turned edges defining a frusto-conical surface having an angle $\beta$ preferably about 45°. The central part of the guiding member 23 has been provided with perforations 25, which communicate with a pipe 28 running inside the tube 26. The guiding member 23 may also be carried out e.g. so that it directly communicates on its underside with the tube 26 of the nozzle member 22.

The operation of the nozzle member 22 may be regulated, for instance, by making the guiding member 23 adjustably controllable horizontally and/or vertically. In this way one is able to influence not only the air flow rate but also the configuration of the annular flow field b discharging through the nozzle element 22.

In FIG. 3, the central axis of the nozzle member 22 has been denoted by K—K and the air-guiding parts of the nozzle member display circular symmetry with reference to the central axis K—K. In the floating dryer of the invention, the central axes K—K of the nozzle members 22 are perpendicular with respect to the carrying plane T—T of the dryer. It is possible according to the invention also to use nozzle elements of a kind deviating from FIG. 3, for instance nozzle members which display elliptical symmetry with reference to the axis corresponding to axis K—K. It is possible in that case, by orienting in a suitable manner the longer and shorter diameter directions of the elliptical annular carrying surface, with reference to the direction of travel F of the web W, to influence the air distribution and also the web stabilizing.

FIG. 2 illustrates one example of the mutual location of the nozzle members 22 of the invention with respect to each other. In this particular configuration there are nozzle members in rows transversal to the direction of travel F of the web W, arranged in a zigzag fashion so that the imaginary triangle obtained by joining the central axes of three mutually adjacent nozzle members 22 (in the carrying plane T—T) is substantially equilateral.

The air-borne drier present in the figures and its nozzle members 22 operate as follows. The drying gas flow is introduced through the entrance passage 11*a* into the distribution headers 12*a*, 12*b*, 12*c* etc. whence it is divided as flow B,C into the tubes 26 of the nozzle members 22 and thereby as flow a further to the radial flow b in contiguity with the carrying surface 24. This flow b causes between the carrying surface 24 and the web W the carrying effect known in prior art. More particularly, by the gas flow discharging from the nozzle slits s in the radial directions illustrated as b in FIGS. 2 and 3 by virtue of the known Coanda effect discussed above in substantially parallel relationship to the web, an extremely efficient web-stabilizing effect is produced on the web due to the subatmospheric pressure created thereby. By virtue of the above, it is only necessary to effect such action on one side of the web while, additionally, the increased flow area resulting from the radial direction of the gas flow increases the turbulence of the flow and thereby improves the transfer of heat into the web. The radial flows b turn, after the edge 27, into downwardly directed flows c, and from the interstices 30 of the distribution headers 12 the gases are directed as flows D through the gratings 29 to the exit passage 11*b*, as exit flow E.

As shown in FIGS. 2 and 3, also at the flow guide member 23 gases are brought into contiguity with the web W. As shown in FIG. 3, this is accomplished in that through the pipe 28 there is directed onto the web a flow field e, which is entrained along with the flow b, producing favourable effects. In the invention the angle $\alpha$ of the annular part formed by the carrying surface 24 is so selected that the cross section of the radial flow b is substantially constant at various points of the carrying surface 24. One may furthermore shape the annular flow passage between the inner part of the annular part with radius of curvature R and the guiding member 23, in view of appropriate air distribution in the radial flow field b. One may also arrange lands between the parts 24 and 23 for confining the flow, e.g. so that the flow in the field b is more strongly directed to those points where the vertical flow c has a larger cross section in the interstices of the nozzle members 22. It is even otherwise possible to shape the configuration of the carrying surface 24, both in the sections parallelling the flow b and in sections at right angles thereto, with a view to obtaining for the flow field b the most favourable shape possible and the best distribution, considering the uniform supporting and stability of the web W and the drying efficiency.

Figure 4:
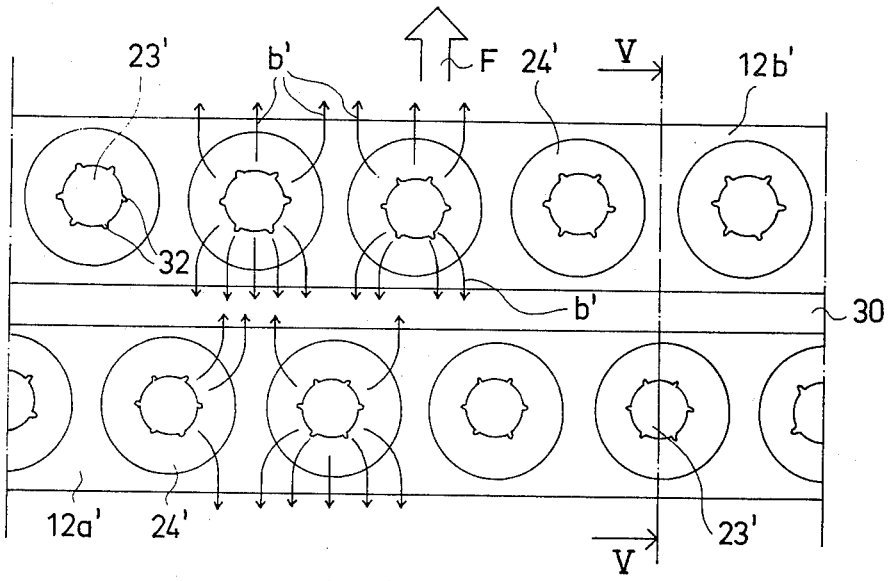
FIG. 4 shows another embodiment of the invention, presented as in FIG. 2, the nozzle elements in this embodiment consisting directly of specially shaped portions of the top wall of the distributor headers.
Figure 5:
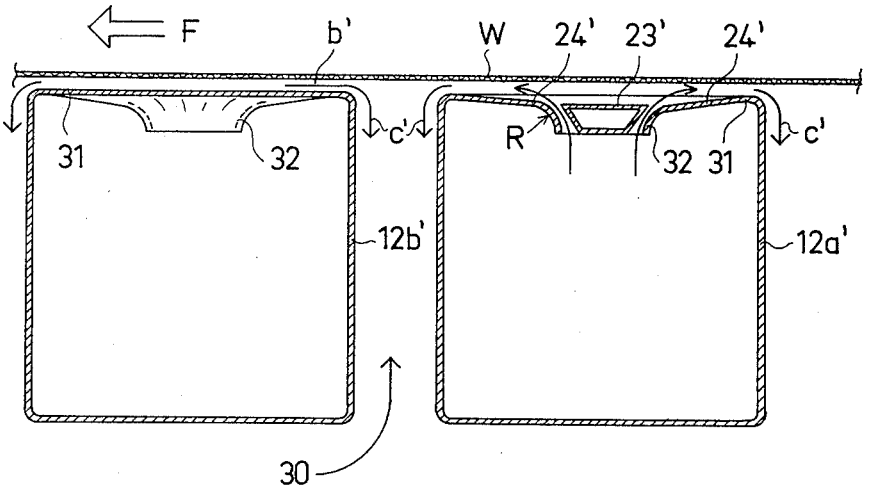
FIG. 5 shows the section carried along line V—V in FIG. 4.

The air has been conducted into the distribution headers 12*a'*, 12*b'* etc. of the embodiment of the invention illustrated in FIGS. 4 and 5 similarly as in FIG. 1. The nozzles of FIGS. 4 and 5 lack the air tubes 26 described above, instead of which the carrying surfaces 24' of the nozzles are directly formed by the cover parts 31 of the distribution headers 12*a'*, 12*b'* etc., there having been formed in these cover parts, in a row, annular nozzle slits so that these are confined on the inside starting from the inner part of the distribution headers by parts 32 with radius of curvature R, their immediate continuation consisting of conical parts constituting the carrying surface 24' and which have been shaped of the material of the distribution header cover 31. In the manner described above there is formed in connection with said carrying surfaces 24', an array of substantially radially disposed flow fields b', which turn to become flows c' in the interstices 30 of the distribution headers 12*a'*, 12*b'* etc.

As shown in FIGS. 4 and 5, the flow is guided by saucer members 23' which in this case are unperforated; thus in this embodiment of the invention no central air is used in the nozzles. The saucer parts 23' attach by projections 32 to the carrying surfaces 24', where appropriate grooves or recesses have been provided for the projections 32. The projections 32 may be so dimensioned and placed that they confine the flow field b' in such manner that two adjacent nozzles will not blow straight against each other.

The flow e; e' coming from the site of the guiding members 23*a;* 23*b* may be employed, for instance, to regulate the distance H at which the web W is held from the carrying surface.

The nozzle members 22 are placed in appropriate manner relative to each other, keeping in mind a uniform supporting action and drying, e.g. so that the streaking of the web can be avoided and the highest uniformity is achieved in the moisture profile. In such case the placement of the nozzle members 22 may differ e.g. from that which has been shown in FIGS. 1, 2 and 4.

We claim:

1. In apparatus for drying a web according to the air supporting principle including a plurality of nozzle members from which a gaseous drying fluid is directed into contiguity with the web to be dried and wherein the web is supported by said gaseous drying fluid, and wherein said nozzle members define a carrying surface along which the gaseous drying fluid is directed to produce the web supporting effect, the improvement comprising: a plurality of nozzle members successively located one after the other both in and transverse to the direction of travel of the web, each of said nozzle members including means defining a substantially annular slit and a carrying surface associated with said annular slit for directing gaseous drying fluid substantially contiguous with said carrying surface in a substantially radial flow field relative to said annular slit and in a direction substantially parallel to the web.

2. The combination of claim 6 wherein said nozzle members are located in displaced relation relative to each other so that the central axes of three adjacent nozzle members define an imaginary substantially equilateral triangle.

3. The combination of claim 1 further including a plurality of substantially parallel elongated distribution headers extending in one of the direction of web travel and the direction transverse thereto, said nozzle members being associated in fluid communication with said distribution headers.

4. The combination of claim 3 wherein each of said nozzle members fluidly communicate with a respective distribution header through a connecting tube.

5. The combination of claim 3 wherein said distribution headers are defined by walls and wherein said annular slit and associated carrying surface of each of said nozzle members are defined by a portion of the wall of a respective distribution header which is in opposed relation to the web, said carrying surfaces being located with respect to each other both in and transverse to the direction of travel of the web.

6. The combination of claim 5 wherein said carrying surfaces defined by the distribution header wall portion each have a substantially frusto-conical configuration.

* * * * *